US005461947A

United States Patent [19]

Batten

[11] Patent Number: 5,461,947

[45] Date of Patent: Oct. 31, 1995

[54] TOOL HOLDER WITH EJECTION SLOT

[76] Inventor: Ronald W. Batten, 5618 White Ct., Torrance, Calif. 90501

[21] Appl. No.: 279,183

[22] Filed: Jul. 22, 1994

Related U.S. Application Data

[63] Continuation-in-part of Ser. No. 4,286, Jan. 14, 1993, abandoned.

[51] Int. Cl.[6] ..... B25B 17/00

[52] U.S. Cl. ..... 81/56; 81/57.14; 279/155

[58] Field of Search ..... 81/54–56, 128–129, 81/57.14, 57.16, 57.36, 57.3, 13; 403/322; 279/155

[56] References Cited

U.S. PATENT DOCUMENTS 3,131,947 5/1964 McCarty et al. ..... 279/155 X 3,358,117 12/1967 White ..... 279/155 X 4,721,022 1/1988 Batten ..... 81/56

*Primary Examiner*—James G. Smith

*Attorney, Agent, or Firm*—Plante and Strauss

[57] ABSTRACT

There is disclosed an improvement to an elongated tool holder such as the tool holders used to secure the immobilizing key used in aerospace fasteners to enable easy ejection of keys which is stuck or jammed in the holder. In these tools, a key is received in a receptacle of a tool holder that is slidably received within an outer, rotationally-driven member which distally supports a socket for engagement with the nut of the fastener of an aerospace fastener. The key is used to immobilize the bolt for non-interference fit applications of the fastener. A slot is formed along the shank of the tool holder intersecting the tool receptacle adjacent its interior end to expose the received end of the key and thereby permit insertion of an ejection member or tool to forcefully eject a jammed key from the tool receptacle.

15 Claims, 3 Drawing Sheets

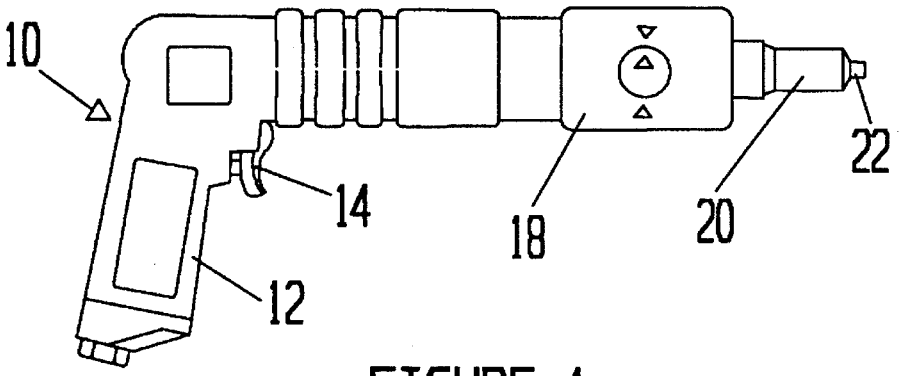
FIGURE 1
FIGURE 3
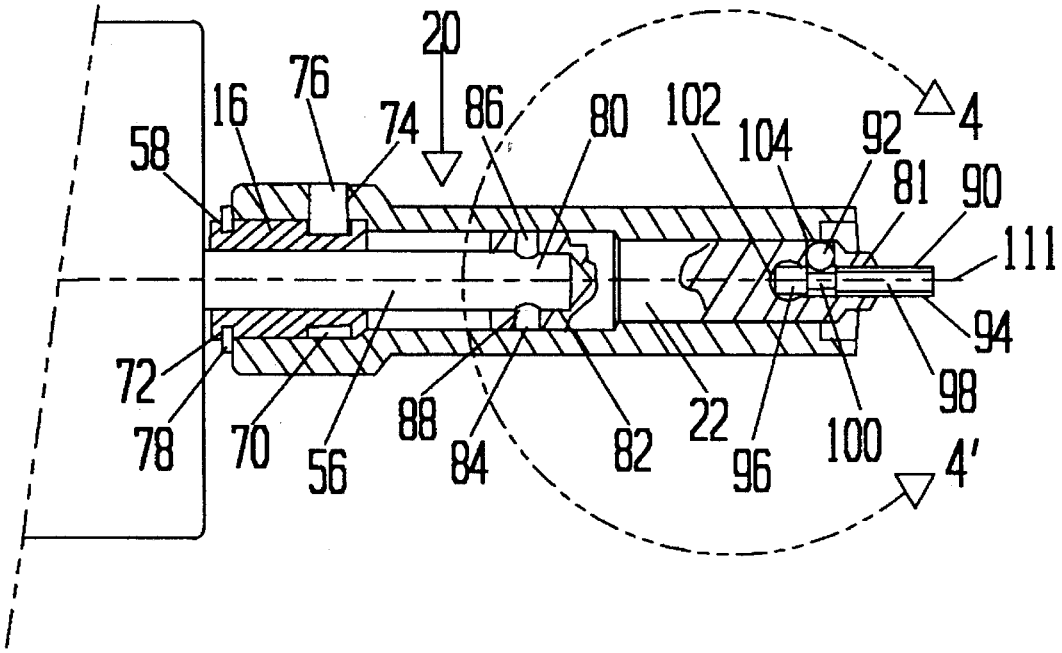

TOOL HOLDER WITH EJECTION SLOT

REFERENCE TO RELATED APPLICATIONS

This application is a continuation-in-part of my application, Ser. No. 08/004,286, filed on Jan. 14, 1993, abandoned.

BACKGROUND OF THE INVENTION

1. Field of Invention

This invention relates to a holder for a tool and, in particular, to a holder for a key used for the attachment of aerospace fasteners.

2. Brief Statement of the Prior Art

A particular fastening system has been developed for use in the aerospace industry, which employs frangible fasteners comprising a bolt with a nut member having a threaded collar and a wrenching ring separated by a notched section that provides a predetermined limiting torque which when exceeded, permits the wrenching ring to shear from the threaded collar, leaving the latter in place at a precise and predetermined tensile loading on the bolt. Often, the threaded collar has an upset portion usually a slightly elliptical shape to provide a frictional spring lock to prevent the fastener from spinning off the bolt in the event that the residual tension on the fastener is lost.

The threaded fasteners are used both in loose and interference fit applications. In loose fit applications in it is difficult to work from both sides of the workpiece, and it has been the practice to use a drive tool to apply the fasteners which has a center key that is inserted into a broached keyway in the end of the bolt to hold the bolt stationary while the threaded collar is applied.

In my prior, parent application, Ser. No. 514,783, now U.S. Pat. No. 4,538,483, I disclose an improved wrenching tool in which a key member is provided with a distal groove and is received in a key holder which has a detent ball that is mounted in a lateral bore and that engages the distal groove of the key member. The key holder is slidably received in a central bore of the rotationally driven socket member which has an interior ball cavity. The precise alignment of the ball cavity in the socket member with the lateral groove of the key holder permits the detent ball to move outwardly, releasing the key and permitting its removal. In my prior application, Ser. No. 823,009, now U.S. Pat. No. 4,721,022, I disclose a release mechanism in the drive tool which precisely locates the detent ball for release of the key.

Keys can become jammed in the keyway of the drive tool, particularly when the end of the key is sheared off during use of the tool. In my aforementioned '844 patent, I disclose that the keyway in the center of the holder can be intersected by a bore drilled at an angle from one side of the holder so that one can insert a pin or other tool to clear the keyway of any jammed portion of a key.

It is difficult to drill a bore at an angle into the holder so that it intersects the tool receptacle or keyway at the necessary location for forcing the ejection of a jammed key. Additionally, this approach requires the use of a relatively slender and, itself, a fragile pin for ejection of the jammed key.

OBJECTIVES OF THE INVENTION

It is an objective of this invention to provide a holder for a tool element having an improved means for ejection of a jammed tool element from the tool holder.

It is a further objective to provide the aforementioned tool holder for use in a rotationally driven tool.

It is a further object of the invention to provide the aforementioned improved tool holder for use to receive a key used in a wrenching tool for application of aerospace fasteners.

Other and related objects will be apparent from the following description of the invention.

BRIEF DESCRIPTION OF THE INVENTION

The invention comprises an elongated tool holder such as the tool holders used to secure the immobilizing key used in aerospace fasteners. In these tools, a key is received in a receptacle of a tool holder that is slidably received within an outer, rotationally-driven member which distally supports a socket for engagement with the nut of the fastener of an aerospace fastener. The key is used to immobilize the bolt for non-interference fit applications of the fastener. In this invention, a slot is formed along the shank of the tool holder intersecting the tool receptacle adjacent its interior end to expose the received end of the key and thereby permit insertion of an ejection member or tool to forcefully eject a jammed key from the tool receptacle.

BRIEF DESCRIPTION OF THE DRAWINGS

The invention will be described with reference to the figures of which:

FIG. 1 is a side view of a typical aerospace fastener power wrench;

FIG. 3 is a sectional view of the tool holder and socket member of the wrench as disclosed in my aforementioned '022 patent;

DESCRIPTION OF PREFERRED EMBODIMENT

Figure 2:
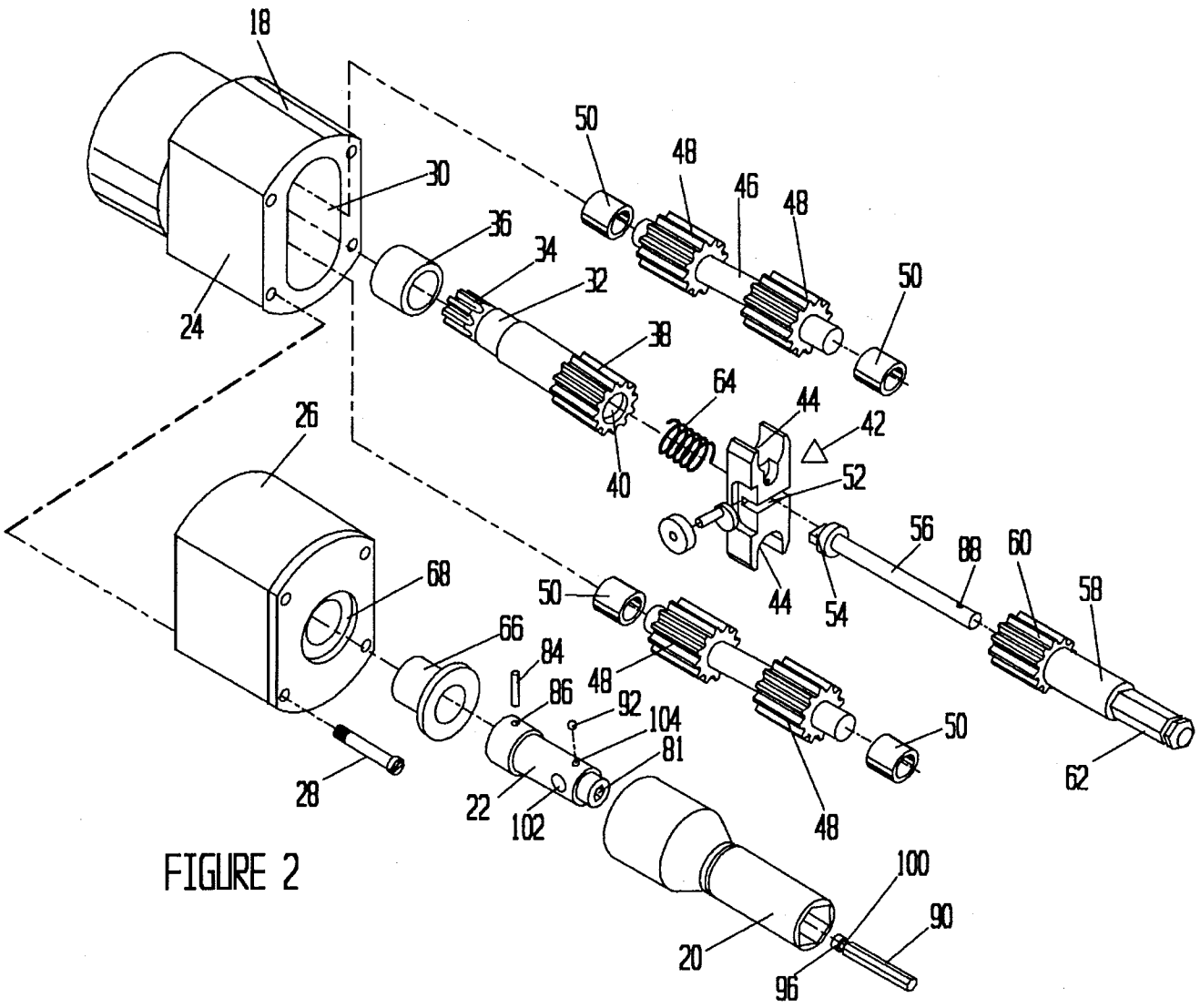
FIG. 2 is an exploded perspective view of the wrenching elements of the power wrench of FIG. 1.

The invention comprises an improvement in a tool holder to provide access to the received end of a tool element within a tool receptacle of the holder for facilitating ejection of a tool which has become jammed in the receptacle. The invention is particularly applicable to the otherwise conventional wrenching equipment used for the application of aerospace fasteners, and the invention will be described with reference to this particular application.

Referring to the FIG. 1, the wrenching tool 10 has a conventional pistol grip 12 with a trigger control 14 and a drive motor assembly (not shown) which typically includes an air motor. The output shaft of the motor is engaged in a gear train within gear housing 18. The gear train has a centrally positioned output shaft which removably receives socket member 20 and a rotationally immobilized, and axially sliding key holder 22 which removably receives a key member, not shown.

Referring now to FIG. 2, the gear train is received in gear housing 18 which is formed of opposite housing ends 24 and 26 which are secured thereto by retaining screws such as 28. The housing 18 has a generally rectangular internal cavity 30. The input drive shaft 32 for the gear train assembly has a splined end 34 which is received by the power output shaft (not shown) of the air motor assembly. Shaft 32 is rotationally received in a central bore (not shown) in the inside end wall of the gear housing end 24 and is provided with a suitable bearing 36. The opposite end of the input shaft 32 has a wide-faced spur gear 38 having a central bore 40 which receives a compression spring 64. A slide block 42 which has a shape closely conforming to the housing cavity 30 of the housing 18 and distal arcuate notches 44 is slidably mounted in housing cavity 30. Each notch 44 provides clearance for a shaft 46 which distally carries a pair of wide-faced spur gears 48. The shafts 44 are mounted in needle bearings 50, which are received in bores (not shown) in the inside wall of housing end 24 and the inside wall housing end 26. The forward face of slide block 42 has a cross slot 52 and this cross slot 52 receives the flatted end 54 of the key shaft 56. The key shaft 56 receives power output sleeve 58 which has a wide-faced spur gear 60 at one end and a flatted hexagonal opposite end 62.

The resulting assembly of the previously described parts provides a gear train assembly in which the power output sleeve 58 is rotationally driven through the assembly of spur gears, 38, 48 and 60, and the key shaft 56 is rotationally restrained by slide block 42. The slide block 42 is slidably mounted in this assembly and in the cavity 30 of the housing 18 such that it and shaft 58 can be axially displaced, against the resilient bias of spring 64, during rotational driving of power output shaft 58.

The remainder of the assembly includes an end support bearing 66 which is received in a central aperture 68 of housing end 26, and the socket member 20 that is removably received over the end of power output shaft 58.

Referring now to FIG. 3, the wrenching tool 10 is shown in elevational view, with the forward portion of the wrenching tool in partial cross section. The socket member 20 is received over the end of the power output shaft 58, which has a first annular groove 70, and a second, smaller annular groove 72. The socket member 20 has an aperture 74 which receives a screw 76 which seats in annular groove 70 to secure the assembly. A retaining ring 78 is seated in the annular groove 72. The outer end 80 of key shaft 56 is received in a central bore 82 in the end of the key holder 22 and is secured thereto by pin 84 which extends through bore 86 in the key holder 22 and an aligned bore 88 (See FIG. 2) in the key shaft 56.

The key member 90 is received in central bore 81 in the outer end of the key holder 22 and is restrained therein by a detent ball 92. This construction provides for the facile removal and replacement of the key member 90. The key member 90 has a working end 94 and a tool insertion end 96. The shank 98 of the key member 90 has a non-circular cross section to provide for its rotational restraint. Preferably, and in accordance with conventional construction, this shank 58 has a hexagonal flatted surface and is received in central bore 81 of the key holder 22 which is broached with a mating hexagonal flatted internal surface. The tool insertion end 96 of key member 90 is cylindrical and has a distal groove 100. The key holder 22 has a cross bore 102 which intersects its central bore 81, thereby providing a precise axial abutment or stop for the insertion end 96 of the key member 22 as well as facilitating the broaching of this central bore. The key holder 22 also has a detent member cavity 104, which can be a through bore which receives the detent member, which is preferably a detent ball 92. The detent ball 92 can be restrained from complete dislodgement from the detent cavity by staking the ends of the cavity.

Figure 4:
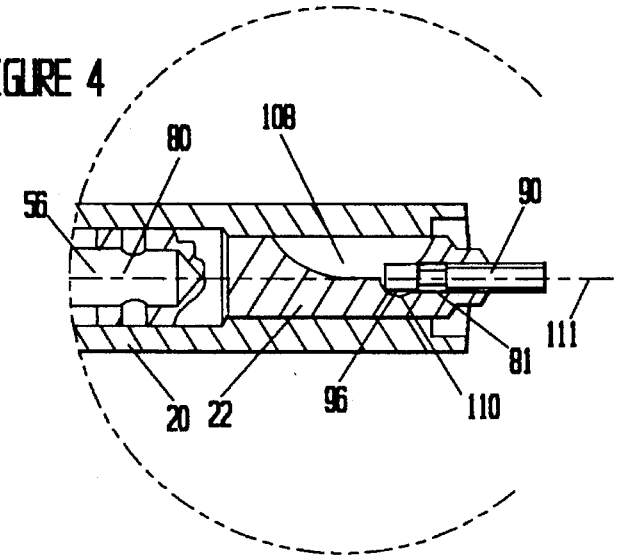
FIG. 4 is a view of the area within line 4—4' of FIG. 3 illustrating the tool holder as modified to add the ejection slot of this invention.

Referring now to FIG. 4, the invention is shown as an elongated axial slot 108 which is milled into the side of the tool holder 22 adjacent the interior end 110 of the central bore 81 and at a sufficient depth that it intersects central bore 81, preferably extending to the center line 111 of the tool holder 22. In this fashion, the insertion end 96 of the key member 90 within the tool holder 22 can be exposed, thereby enabling a user to insert an ejection element such as a key, screwdriver blade and the like, to pry or forcefully eject the key member 90 by pushing against the insertion end 96 of the key member 90 within the central bore 81.

Figure 5:
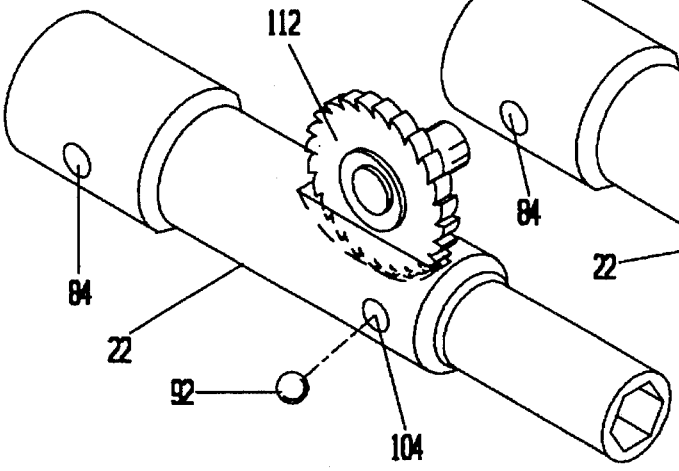
FIG. 5 is a perspective view of the tool holder during machining of the ejection slot of this invention.
Figure 6:
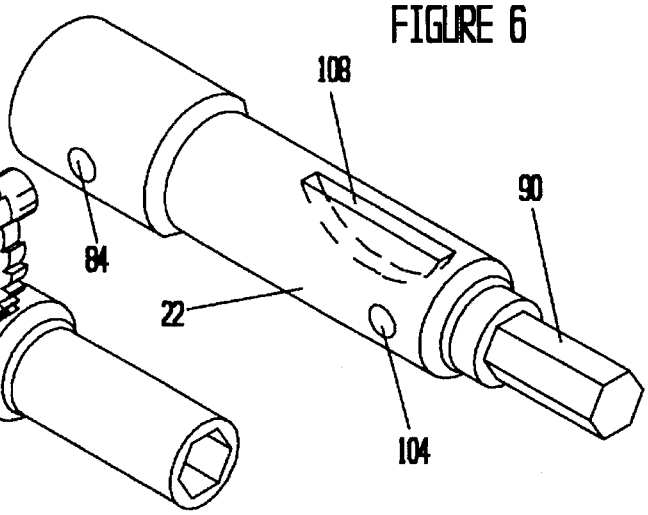
FIG. 6 is a perspective view of the tool holder with the access slot.

Referring now to FIG. 5, there is illustrated the preferred method of forming the elongated slot 108. As previously mentioned, the angled bore which is disclosed in my prior '483 patent is difficult to machine and provides only limited access to a jammed key in the tool holder. The slot 108 of this invention can be readily cut into the tool holder 22 using a conventional milling machine provided with a Woodruff cutter 112 or similar cutting head in a relatively simple and fast machining step. The result is to form an elongated slot 108 having a generally arcuate bottom along the shank of the tool holder 22, as illustrated in FIG. 6. As previously mentioned, this elongated slot 108 provides adequate access to the received insertion end 96 of a tool such as a key member 90 and permits the facile and forced ejection of any key member 90 from the tool receptacle, central bore 81.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. In a holder for a tool element which has a tool receptacle extending from one end thereof and an interior end within said holder for the removable reception of a tool within said receptacle, the improvement which comprises an elongated blind slot extending axially along the length of said holder with a depth to about the centerline of said holder and an arcuate bottom, and intersecting said receptacle adjacent its interior end, to expose the received end of said tool, whereby an element can be inserted into said slot into contact with said received end of said tool and moved axially along said holder for forced ejection of said tool from said receptacle.

2. The holder of claim 1 wherein said holder member has a cross bore which intersects said receptacle, with a ball seated in said cross bore and wherein said tool has an annular groove about its shank which provides a recess for said ball.

3. The holder of claim 1 wherein said receptacle has at least one flatted interior wall, and the shank of said tool has a mating cross section.

4. The holder of claim 1 in combination with a wrench having a rotationally driven member having a distal socket and a central through bore with said holder slidably received in said through bore and rotationally restrained therein.

5. The holder of claim 4 including a spring retainer carried on said wrench and engaged with said holder to rotationally restrain said holder.

6. The combination of a rotational wrenching tool which comprises a rotationally driven member that distally supports a socket and has a central through bore, an elongated tool holder slidably received in said through bore and having a tool receptacle extending from one end thereof with the interior end of said tool receptacle terminating within said holder, a tool with its shank end removably received within said tool receptacle, and an elongated blind slot extending axially along the length of said holder with a depth to about the centerline of said holder and an arcuate bottom, and intersecting said tool receptacle adjacent its interior end, to expose the received end of said tool, whereby an ejection element can be inserted into said slot into contact with said received end of said tool and moved axially therein for forced ejection of said tool from said receptacle.

7. The combination of claim 1 including detent means to secure said tool element within said tool receptacle which comprises a cross bore in said holder intersecting said tool receptacle adjacent its interior end, with a detent ball seated in said cross bore.

8. The combination of claim 7 wherein said tool element has an annular groove about its shank end which, when aligned with said cross bore provides a recess for said ball, whereby said ball serves as a detent to retain said tool element within said tool receptacle.

9. The combination of claim 7 wherein said tool receptacle has at least one flatted interior wall, and the shank of said tool has a mating cross section.

10. The combination of claim 9 wherein said holder is slidably received in said through bore and rotationally restrained therein.

11. The combination of claim 10 including a spring retainer carried on said wrench and engaged with said holder to rotationally restrain said holder.

12. The combination of claim 11 wherein said rotationally driven member has external gear teeth for driving engagement with gear means internally mounted in said wrench.

13. The combination of claim 12 including power means carried in said wrench to drive said rotationally driven member.

14. The combination of claim 7 wherein said tool element is a key having a work end with wrenching flats to be received in a socket of a fastener element.

15. The combination of claim 14 wherein said fastener element is a bolt having a socket in its threaded end to receive said key.

* * * * *